United States Patent [19]

Reba et al.

[11] Patent Number: 4,643,775

[45] Date of Patent: Feb. 17, 1987

[54] FABRIC CONDITIONING AND CLEANING SYSTEM

[75] Inventors: Imants Reba, Vancouver, Wash.; Rodney E. Pollock, Portland, Oreg.

[73] Assignee: Crown Zellerbach Corporation, San Francisco, Calif.

[21] Appl. No.: 626,072

[22] Filed: Jun. 29, 1984

[51] Int. Cl.[4] ..... B08B 1/02

[52] U.S. Cl. ..... 134/15; 15/302; 15/306 A; 15/316 R; 134/30; 134/122 R; 68/6; 8/149.3; 162/99; 239/DIG. 7

[58] Field of Search ..... 15/302, 306 A, 316 R; 134/15, 30, 122 R; 68/6; 8/149.3; 162/199, 206, 275, 290, 359; 239/DIG. 7

[56] References Cited

U.S. PATENT DOCUMENTS

| | | | |
|---|---|---|---|
| 3,574,261 | 4/1971 | Bailey | 15/306 A |
| 3,735,778 | 5/1973 | Garnier | 239/DIG. 7 |
| 3,775,806 | 12/1973 | Olbrant et al. | 15/306 A |
| 3,859,205 | 1/1975 | Reba et al. | 239/DIG. 7 |
| 4,011,623 | 4/1977 | Pabst et al. | 15/306 A |
| 4,270,978 | 6/1981 | Fioravanti | 15/302 |
| 4,308,096 | 12/1981 | Cronin | 165/275 |
| 4,444,622 | 4/1984 | Dove | 162/290 |

*Primary Examiner*—Andrew H. Metz
*Assistant Examiner*—Sharon T. Cohen
*Attorney, Agent, or Firm*—Stanley M. Teigland

[57] ABSTRACT

A method and apparatus for cleaning and conditioning a fabric in which pressurized fluid is directed into a restricted and diminishing passageway formed by the fabric and a member forming an extended nip therewith so that the fluid is forced through the fabric.

17 Claims, 2 Drawing Figures

FABRIC CONDITIONING AND CLEANING SYSTEM

BACKGROUND OF INVENTION

This invention relates to a method and an apparatus for cleaning and conditioning fabrics, e.g. felts and wires on a papermaking machine.

Wires and felts employed on papermaking machines often operate under conditions which result in such fabrics continuously accumulating foreign matter such as clays and other residues associated with the papermaking process. This situation becomes even more aggravated when recycled paper is used as a fiber source. Such accumulations, if not removed, create severe operational problems and inefficiencies.

While fabric cleaners are known, such prior art systems have been found ineffective to remove the more tenacious contaminants, in particular those contaminants resulting from recycled fiber stock.

The present invention has been found to be more highly effective in the removal of contaminants from fabrics than conventional prior art approaches. In addition, the present invention has proved very useful in the conditioning of fabrics such as felts by raising the nap thereof to increase efficiency of operation.

BRIEF SUMMARY OF THE INVENTION

The method and apparatus of the present invention have in common with prior art fabric cleaners the fact that a pressurized fluid is employed in the cleaning process. The method and apparatus differ significantly however, in how the pressurized fluid is employed. These differences result in a highly efficient use of the pressurized fluid to remove residues conventionally found in papermaking and similar processes.

According to the teachings of the present invention, a fluid is directed under pressure through an elongated restricted opening positioned adjacent to a generally smoothly curved fluid flow attachment surface. The surface defines an extended nip with a fabric, and the fabric and surface also form a restricted and diminishing passageway leading to the nip. The fluid attaches itself to the surface due to the Coanda effect and follows the contours thereof into the passageway toward the nip. This fluid movement creates pressure differentials at the fabric and these differentials cause fluid to pass through the fabric, thereby removing foreign matter from the fabric and conditioning the fabric.

DETAILED DESCRIPTION

Figure 1:
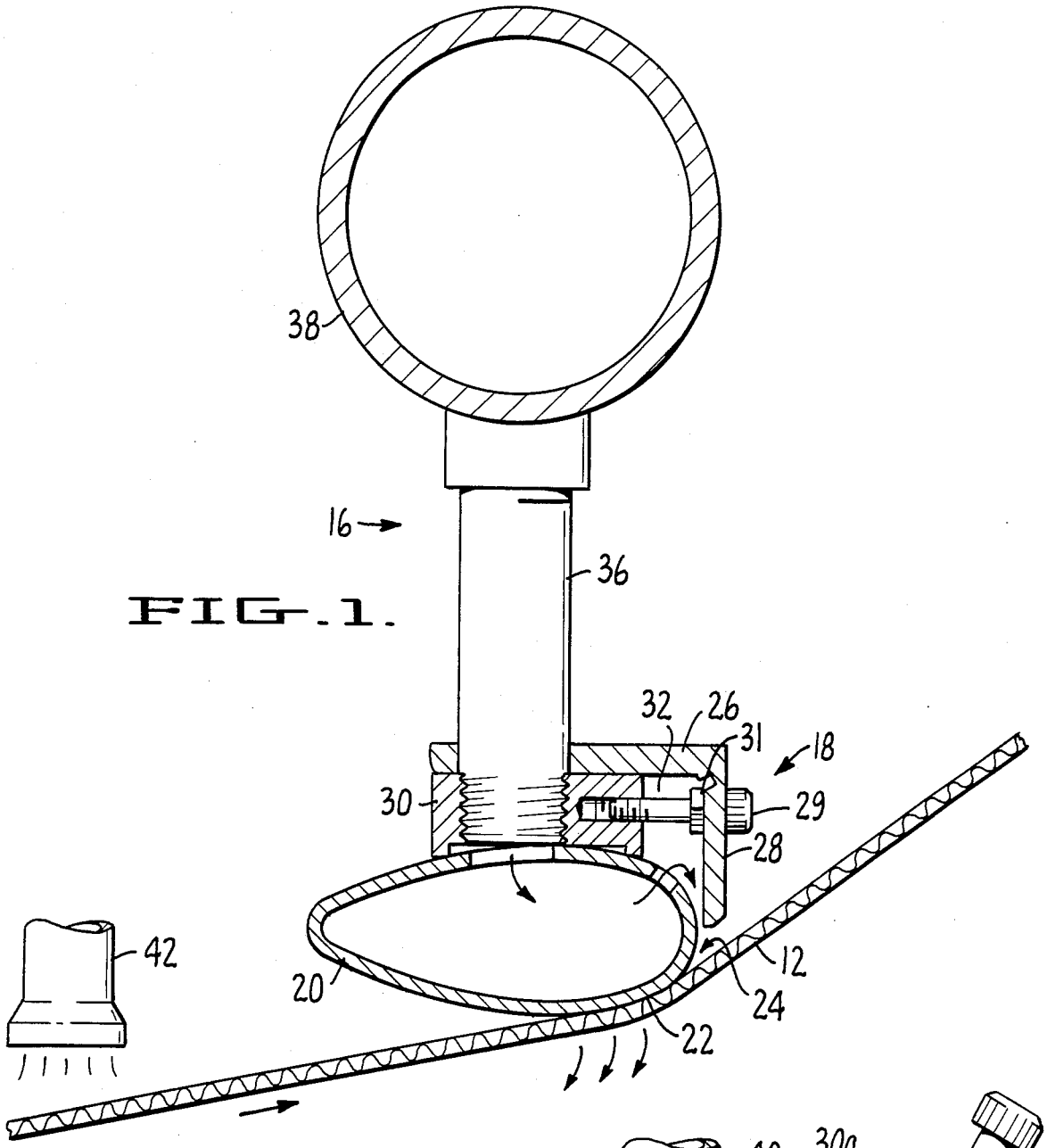
FIG. 1 is a schematic elevational view of a preferred form of apparatus constructed in accordance with the teachings of the present invention.

Referring to FIG. 1, a preferred form of apparatus constructed in accordance with the teachings of the present invention, and utilized to carry out the method of the invention, as illustrated. In that figure, a portion of a fabric 12 moving in the direction of the arrow associated with the web is illustrated. In the FIG. 1 embodiment, for purposes of illustration, the fabric is a papermaker's felt having a backside (the upwardly facing side) and a frontside (the downwardly facing side), but it is to be understood that the principles of the present invention may be applied to any suitable fabric, such as, for example, a paper machine wire.

A web cleaner device, designated generally by reference numeral 16, is positioned along the predetermined path of movement of the felt and closely adjacent thereto. Device 16 includes a Coanda nozzle 18 having a foil 20. As may be clearly seen with reference to FIG. 1, the foil extends at right angles to the direction of fabric movement and includes a generally smoothly curved surface 22 for defining an extended nip with the foraminous web. Said nip need not necessarily be a closed nip. The present invention is operational even when the nip is slightly open.

Surface 22 defines with the fabric a restricted and diminishing passageway generally indicated by reference numeral 24, which terminates at the nip.

Also comprising a portion of the Coanda nozzle 18 is a bracket 26 having a leg element 28. The free terminal end of leg element 28 defines with the foil 20 an elongated restricted opening in the form of a slit. The slit has a generally uniform width along its length lying within the range of from about 0.002 inches to about 0.005 inches. The width of the slit may be adjusted by means of a plurality of screws 29 positioned at space intervals along the length of leg element 28 and cooperating with lock nuts 31.

The bracket 26, foil 20, and a mounting member 30, to which the foil 20 is attached by any suitable means, define a pressurized fluid chamber 32. Although not illustrated, it is to be understood that the chamber 32 is substantially closed at the ends thereof by any suitable means such as end plates so that pressurized fluid in the chamber will be forced through the slit defined by leg element 28 and foil 20.

A conduit 36 leads from the Coanda nozzle 18 to a supply header 38 which is filled with pressurized steam or other suitable cleaning fluid. It will be appreciated that the pressurized fluid will pass downwardly through the interior of conduit 36 and into pressurized chamber 32 through passageways 33 and 35 formed in foil 20. In the practice of the present invention it is preferred that steam be utilized as the cleaning agent.

According to the method of the present invention, the steam is directed under pressure through the slit, preferably at a pressure witin the range of from about 20 psig to about 60 psig. The fluid flow, due to the Coanda effect, attaches itself to the generally smoothly curved Coanda fluid attachment surface adjacent to the slit. The fluid then flows along the curvature of the surface away from the slit and enters restricted and diminishing passageway 24.

Because of the generally fluid impermeable extended nip defined by fabric 12 and foil 20, the fluid flow is directed through the fabric to expel foreign matter therefrom. It will be appreciated that the flow of pressurized fluid includes a primary flow component, i.e., the steam that has passed through the slit, and a secondary flow component, which is the ambient air entrained by the primary flow component. The combined effect of the flows of these two fluid components is to create significant pressure differentials in the vicinity of the nip and passageway, thereby greatly adding to the effectiveness of the system.

It has been found that operational effectiveness is increased by moving the foraminous web relative to surface 22 in a direction generally opposed to the direction of movement of the fluid flow in the passageway. To enhance cleaning, sometimes it may be desirable to spray a mixture of water and detergent onto the fabric prior to its passage past the Coanda nozzle 18. In FIG. 1, a spray nozzle 42 for accomplishing this objective is illustrated in schematic fashion.

Figure 2:
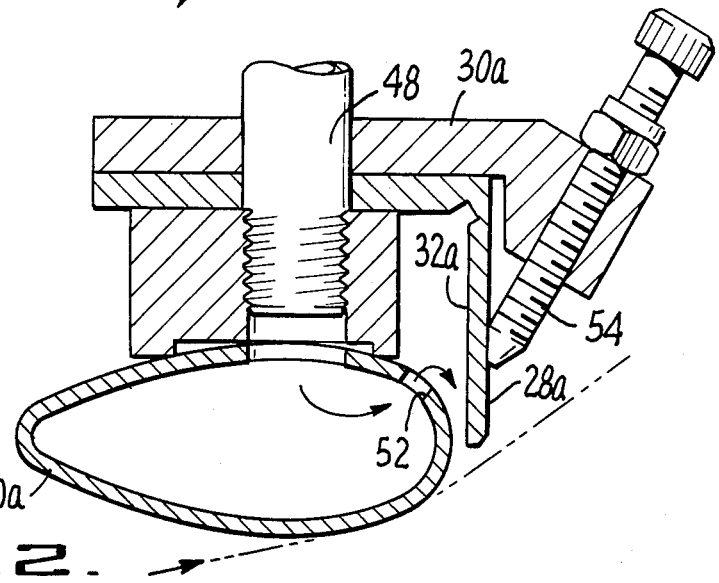
FIG. 2 is a schematic elevational view of an alternative form of Coanda nozzle which may be utilized to practice the present invention.

FIG. 2 illustrates an alternative embodiment of apparatus constructed in accordance with the teachings of the present invention. In this embodiment, bevel ended adjustment screws 54 are threadedly mounted in mounting member 30*a*. The screw is positioned at an angle so that as it is moved downwardly with respect to the mounting member 30*a*, it forces the free end of leg element 28*a* closer to foil 20*a*. In like manner, upward movement of the screw will result in leg element 28*a* moving further away from the foil 20*a* due to the inherent resilience of the material used in its construction, which may for example be stainless steel. A lock nut 60 is used to secure the screw 54 in its desired position. It will be appreciated that the screws deployed along the full length of the device may be individually adjusted as desired. This embodiment has the advantage of eliminating the possibility of pressurized cleaning fluid leakage around the adjustment screws.

We claim:

1. A method of cleaning and conditioning a fabric with pressurized fluid from a Coanda nozzle comprising: positioning a generally smoothly curved Coanda fluid flow attachment foil surface adjacent to a slit defining element to form an elongated slit; directing said fluid in a predetermined direction under pressure through said slit whereby fluid attaches to said foil surface after passage through said slit and whereby said fluid deviates from the predetermined direction and flows along the curvature of said surface due to the Coanda effect away from said slit and ambient air is entrained with said fluid as the fluid flows along the curvature of the foil surface; disposing said fabric closely adjacent to said foil surface and in registry with at least a portion of said surface whereby said fabric and said surface define a restricted and diminishing passageway terminating at an extended nip between said fabric and said surface; moving said fabric relative to said surface and in a path of movement spaced away from said slit and generally at right angles thereto; directing the combined fluid and ambient air flow into said passageway along said foil surface toward said extended nip and thereby creating pressure differentials at said fabric in the vicinity of said nip and passageway with said fluid and ambient air; and utilizing the pressure differentials created by said fluid and ambient air to condition said fabric and remove foreign matter from said fabric.

2. The method of claim 1 wherein said fabric is moved relative to said surface in a direction generally opposed to the direction of movement of the fluid flow in said passageway.

3. The method of claim 1 including the additional step of applying moisture to said fabric prior to formation of pressure differentials at said fabric.

4. The method of claim 1 wherein said fluid is steam.

5. The method of claim 4 wherein said steam is directed through said slit under pressure within the range of from about 20 psig to about 60 psig.

6. The method of claim 3 wherein the step of applying moisture to said fabric is carried out by spraying water on said fabric.

7. The method of claim 1 wherein said slit has a generally uniform width of from about 0.002 inches to about 0.005 inches.

8. A method of cleaning and conditioning a fabric, comprising the steps of:

moving said fabric in a predetermined direction;

during said fabric movement bringing said fabric into close proximity with a Coanda nozzle having a foil defining a generally smoothly curved Coanda fluid flow attachment surface and a slit defining element spaced from said fluid flow attachment surface and extending across at least part of the width of said fabric;

maintaining said fabric and a predetermined portion of said surface in close proximity and in at least partial registry to define a nip therebetween;

forming a diminishing passageway between said surface and said fabric leading to said nip;

directing a fluid in a predetermined direction under pressure through a slit defined by the surface of said foil and said slit defining element and spaced from said fabric and generally at right angles thereto and engaging said fluid with said Coanda fluid flow attachment surface;

utilizing the Coanda effect to attach the fluid to said Coanda fluid flow attachment surface of said foil while substantially simultaneously entraining ambient air with said fluid; and directing the combined flow of pressurized fluid and ambient air into said passageway along said Coanda fluid flow attachment surface toward said nip whereby said fluid and said ambient air create pressure differentials at said fabric in the vicinity of said passageway and nip; and utilizing the pressure differentials to remove foreign matter from said fabric and condition said fabric.

9. The method of claim 8 wherein said predetermined direction of fabric movement is generally opposed to the flow of pressurized fluid into said passageway.

10. The method of claim 8 additionally comprising the step of moisturizing said fabric prior to bringing said fabric into close proximity with said surface.

11. In combination:

a fabric movable along a predetermined path of movement in a predetermined direction; and a Coanda nozzle positioned along said predetermined path of movement and closely adjacent to said fabric, said Coanda nozzle extending generally at right angles to the direction of fabric movement and in at least partial registration with said fabric, said Coanda nozzle including a generally smoothly curved Coanda fluid flow attachment foil surface for defining an extended nip with said fabric and for further defining with said fabric a restricted and diminishing passageway terminating at said nip and communicating with ambient air, said Coanda nozzle additionally including a slit defining element defining an elongated slit with said generally smoothly curved Coanda fluid flow attachment foil surface generally at right angles to said fabric and spaced from said fabric, said slit defining element and said generally smoothly curved Coanda fluid flow attachment surface cooperable to direct pressurized fluid exiting from said slit and ambient air entrained thereby along said surface due to the Coanda effect whereby pressure differentials will be created at the fabric in the vicinity of said passageway and nip by the combined fluid and ambient air and at least a portion of said fluid will be forced through said fabric to expel foreign matter therefrom.

12. The combination of claim 11 wherein said elongated slit has a generally uniform width lying within the range from about 0.002 inches to about 0.005 inches.

13. The combination of claim 11 additionally comprising means for applying moisture to said fabric upstream from said extended nip.

14. The combination of claim 11 wherein said fabric is a papermaker's felt.

15. The combination of claim 11 wherein said fabric is a wire on a papermaking machine.

16. The combination of claim 11 wherein said fabric cleaner device extends across the full width of said fabric.

17. The combination of claim 12 wherein said slit defining means comprises said generally smoothly curved Coanda fluid flow attachment surface and a slit defining element adjustable relative to said surface to selectively vary the width of said slit.

* * * * *